US005458328A

United States Patent [19]

Dubose

[11] Patent Number: 5,458,328

[45] Date of Patent: Oct. 17, 1995

[54] TENNIS NET AND BALL SYSTEM

[76] Inventor: Kenna Dubose, 4401 Gary La., Amarillo, Tex. 79110

[21] Appl. No.: 181,805

[22] Filed: Jan. 18, 1994

[51] Int. Cl.[6] ..... A63B 6/00

[52] U.S. Cl. ..... 273/29 B

[58] Field of Search ..... 273/29 B, 30, 273/346, 347, DIG. 30

[56] References Cited

U.S. PATENT DOCUMENTS

| | | | |
|---|---|---|---|
| 795,317 | 7/1905 | Tanty | 273/29 B |
| 4,240,639 | 12/1980 | Bolton | 273/346 |
| 4,440,393 | 4/1984 | Smith | 273/29 B |
| 4,586,089 | 2/1986 | Jenkins et al. | 273/29 B |
| 4,834,393 | 5/1989 | Feldi | 273/DIG. 30 |
| 4,895,366 | 1/1990 | Bartasius | 273/29 B |
| 4,919,421 | 4/1990 | Vanderveld | 273/29 B |
| 4,948,129 | 8/1990 | Bartasius | 273/29 B |
| 4,997,185 | 3/1991 | Bartasius | 273/29 B |
| 5,080,374 | 1/1992 | Yu | 273/346 |
| 5,234,214 | 8/1993 | Sexton | 273/DIG. 30 |

*Primary Examiner*—Theatrice Brown

[57] ABSTRACT

A new and improved tennis net system comprising an expanse of meshwork stretched across the center of a tennis court between two support posts. The outer surface of the system being covered with hook and loop fasteners for coupling tennis balls or the like thereto.

2 Claims, 3 Drawing Sheets

TENNIS NET AND BALL SYSTEM

BACKGROUND OF THE INVENTION

1. Field of the Invention

The present invention relates to tennis net system and more particularly pertains to tennis net system which may be used to provide a ball receptacle for the server while practicing tennis.

2. Description of the Prior Art

Tennis serving practice among those who have no partner or attendant involves a relatively short period of serving balls and an even longer period spent in retrieving then from the court, shrubbery and other final destinations. Solo tennis enthusiasts have long sought a convenient method of serving balls to the desired zone of a tennis net without having to spend undue time and effort in collecting then before serving the next round of balls. The present invention provides a means of retaining tennis balls so that practice time can be optimized.

The use of tennis net systems is known in the prior art. More specifically, tennis net systems heretofore devised and utilized for the purpose of providing a receptacle for tennis enthusiasts are known to consist basically of familiar, expected and obvious structural configurations, notwithstanding the myriad of designs encompassed by the crowded prior art which have been developed for the fulfillment of countless objectives and requirements.

The present invention is directed to improving devices for tennis net systems in a manner which is safe, secure, economical and aesthetically pleasing.

For example, U.S. Pat. No 4,941,663 to Walker discloses an L-shaped tennis service catching net which stands on or about the boundaries formed by lines defining the service area in a corner of a tennis court. The disclosure would stand as an obstruction to normal play if not removed from the court after use.

U.S. Pat. No. 3,689,067 to Bramley discloses a tennis net and method of making same using a meshwork and an edge band folded containing plastic folded over on itself and heat welded to clinch the meshwork. The disclosure makes no provision for retaining served tennis balls.

U.S. Pat. No. 4,886,268 to Langslet describes a ball capturing tennis net assembly comprising a secondary net used in addition to a conventional tennis net as a means of capturing tennis balls. The disclosure makes no provision for a target at which the server could aim a serve.

Another patent of interest is U.S. Pat. No. Des. 271,507 to Phillips et al disclosing a stand-up tennis ball catch net. The disclosure would have to be moved off of a tennis court before normal use of the court could resume, i.e., play could begin.

Finally, U.S. Pat. No. 4,997,185 to Bartasius describes a ball-retaining tennis net which consists of two layered meshwork's which trap tennis balls. The disclosure makes no provision for a target at which the server could aim a serve.

In this respect, the tennis net system according to the present invention substantially departs from the conventional concepts and designs of the prior art, and in so doing provides an apparatus primarily developed for the purpose of tennis systems.

Therefore, it can be appreciated that there exists a continuing need for new and improved tennis net system which can be used to provide a receptacle for tennis enthusiasts. In this regard, the present invention substantially fulfills this need.

As illustrated by the background art, efforts are continuously being made in an attempt to provide a receptacle for tennis enthusiasts. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of tennis net systems now present in the prior art, the present invention provides an improved tennis net system construction wherein the same can be utilized for providing a target and receptacle for tennis enthusiasts. As such, the general purpose of the present invention, which will be described subsequently in greater detail, is to provide a new and improved tennis net system which has many of the advantages of the tennis net systems mentioned heretofore and many novel features that result in a tennis net system which is not anticipated, rendered obvious, suggested, or even implied by any of the prior art tennis net systems, either alone or in any combination thereof and which has none of the disadvantages of the prior art tennis net systems.

The invention is defined by the appended claims with the specific embodiment shown in the attached drawings. For the purpose of summarizing the invention, the invention may be incorporated into a new and improved tennis net system comprising an expanse of meshwork stretched across the center of a tennis court between two support posts. The outer surface of the system being covered with hook and loop fasteners for coupling tennis balls or the like thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved tennis net system comprising an expanse of meshwork stretched across the center of a tennis court between two support posts. The tennis net system meshwork portion has a top end, a bottom end, a first vertical edge, a second vertical edge, and a front and back wall surface integral with and extending between the top and bottom ends and first and second vertical edge for use in the sport of tennis.

It is therefore an additional object of the present invention to provide a new and improved tennis net system which has all the advantages of the prior art tennis net target and ball receptacle systems and none of the disadvantages.

It is another object of the present invention to provides a new and improved tennis net system which may be easily and efficiently manufactured and marketed.

It is a further object of the present invention to provide a new and improved tennis net system which is of a durable and reliable construction.

An even further object of the present invention is to provide a new and improved tennis net system which is susceptible of a low cost of manufacture with regard to both materials and labor, and which accordingly is then susceptible of low prices of sale to the consuming public, thereby making such tennis net systems economically available to the buying public.

Still yet another object of the present invention is to provide a new and improved tennis net system which provides in the apparatuses and methods of the prior art some of the advantages thereof, while simultaneously overcoming some of the disadvantages normally associated therewith.

Yet another object of the present invention is to provide a new and improved tennis net target system which requires no special tools, hardware, or procedure to install and may be used with existing tennis courts without modification.

Even still another object of the present invention is to provide a new and improved new and improved tennis net system which enables the server to observe where net balls have fallen short, thus providing an important means of user feedback.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
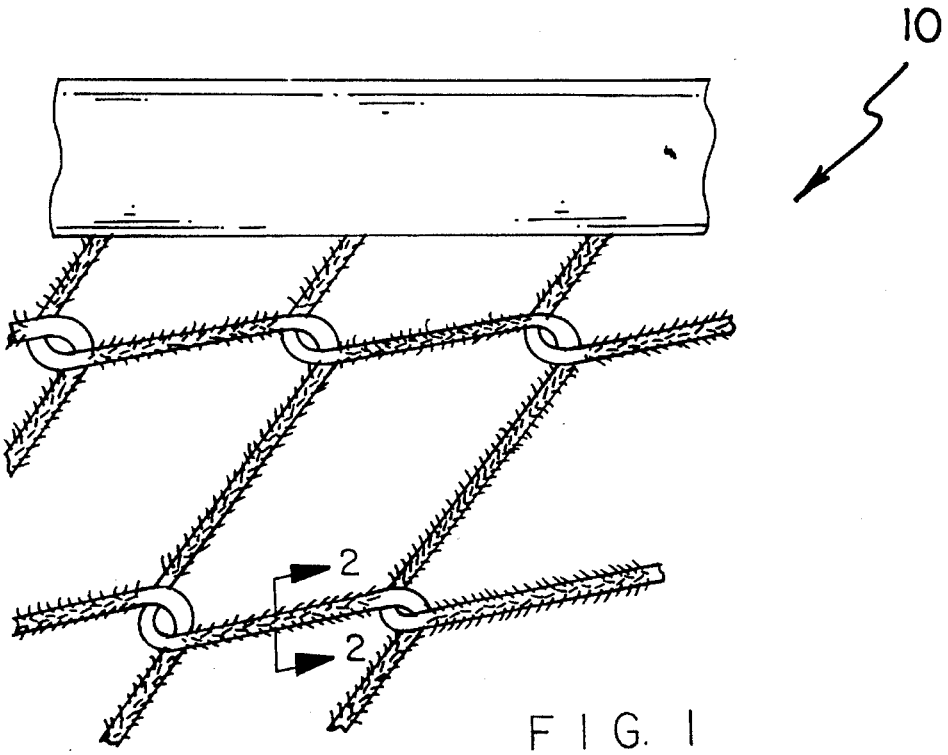
FIG. 1 is a partial perspective view of the meshwork portion showing the meshwork twine and hook and loop fastener outer portion of the present invention.

With reference now to the drawings, and in particular to FIG. 1 thereof, a new and improved tennis net system embodying the principles and concepts of the present invention and generally designated by the reference numeral 10 will be described.

From an overview standpoint, the tennis net system is adapted for use with a tennis net. See FIG. 1.

More specifically, the tennis net system comprises a meshwork portion 10 having a top end 16, a bottom end 18, a first vertical edge 20, a second vertical edge 22, and a front and back wall surface 24 and 26 integral with and extending between the top and bottom ends and first and second vertical edge. The meshwork portion of the tennis net target and ball receptacle system includes an inner core portion 12 incorporating a hook and loop outer portion 14 surrounding the core portion for mating with the napped fabric outer surface of a tennis ball.

Balls striking the net are thus captured, saving the server the trouble of retrieving them. The net meshwork further comprises a suspension cord 28 and a bottom hem weight 30 for suspending the meshwork and keeping said meshwork taut and at the proper attitude during use. The present invention is suspended at the center of a tennis court between two vertical support members for use in the sport of tennis.

Figure 2:
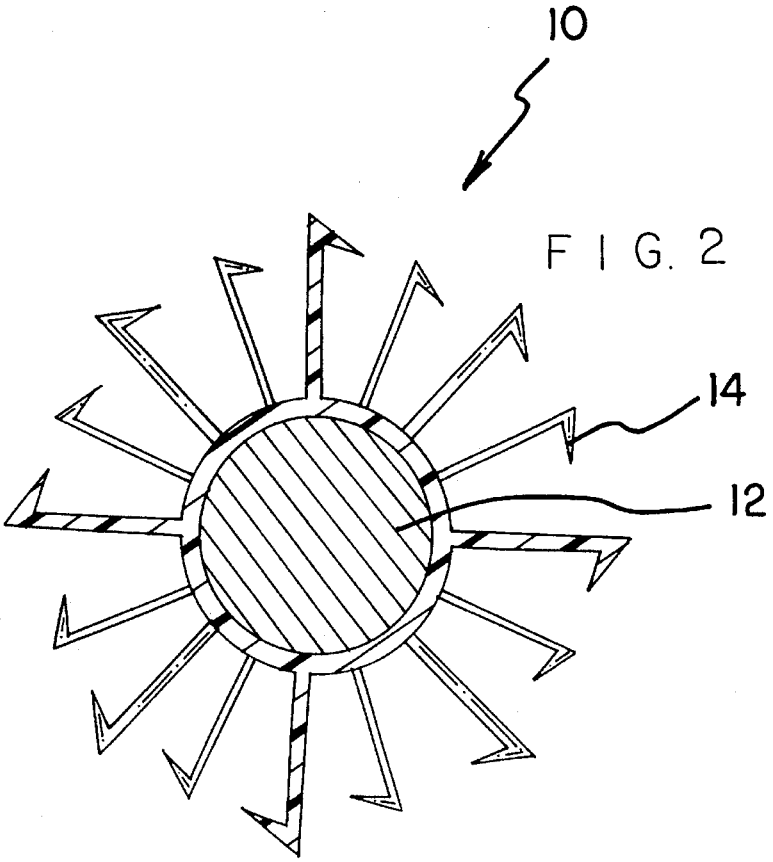
FIG. 2 is a partial cross-sectional view taken along lines 2—2 of FIG. 1 showing the twine and hook and loop fastener outer portion and inner core portion of the present invention.
Figure 3:
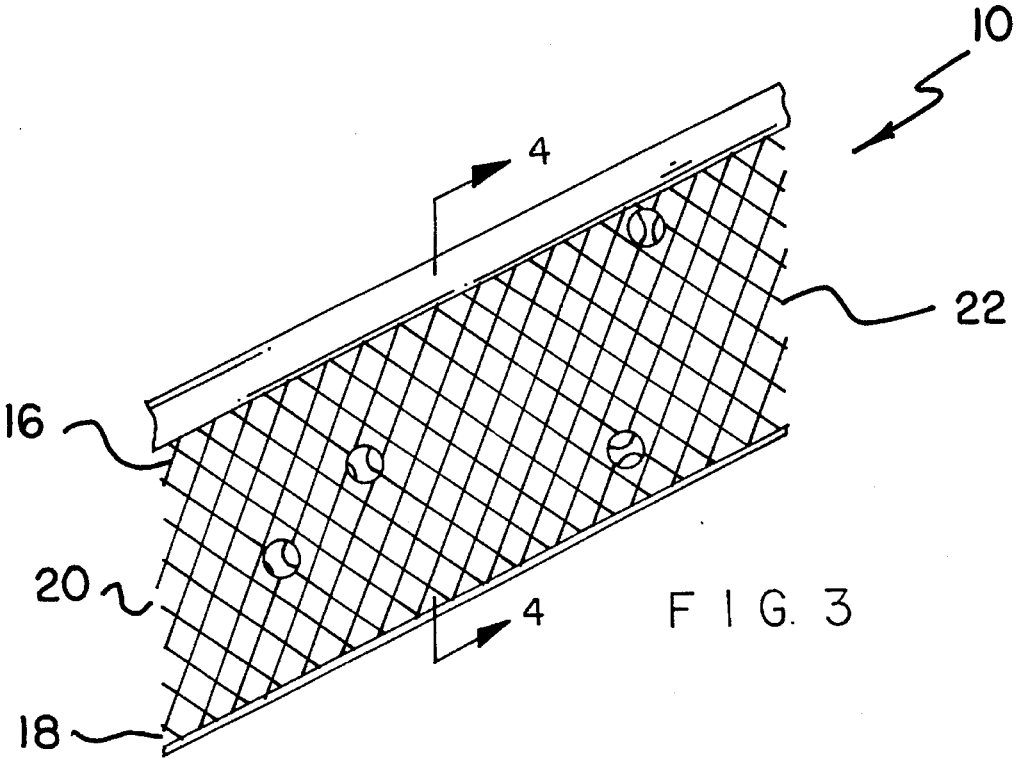
FIG. 3 is a partial perspective view showing the meshwork portion with captured served balls attached to the present invention.
Figure 4:
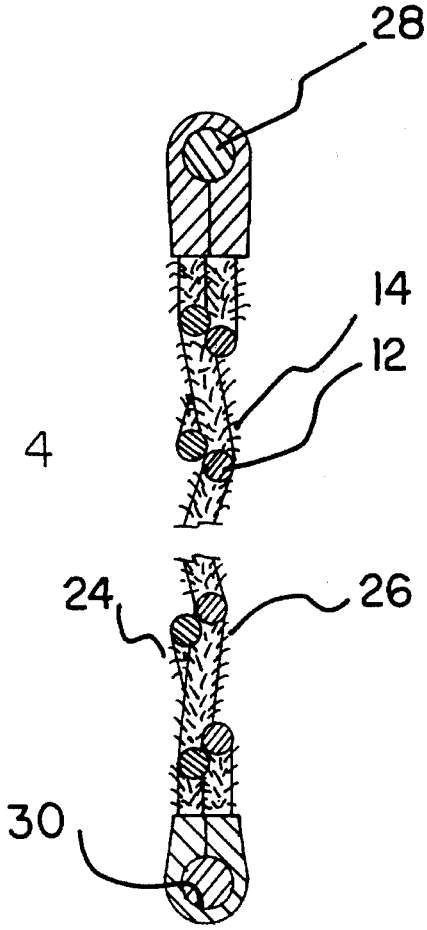
FIG. 4 is a partial cross-sectional view taken along lines 4—4 of FIG. 3 showing the suspension cord, meshwork, and bottom hem weight of the present invention.
Figure 5:
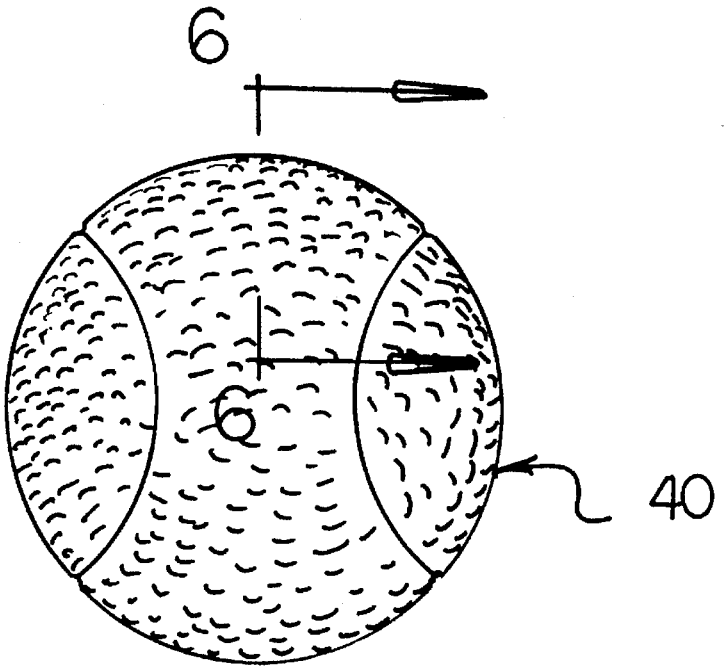
FIG. 5 is an elevational view of a conventional regulation tennis ball except for the exterior surface thereof.
Figure 6:
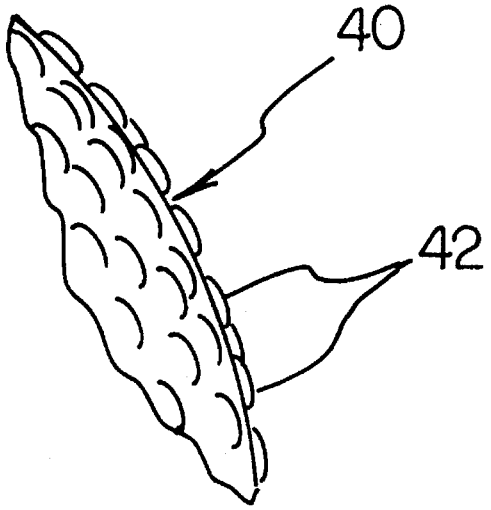
FIG. 6 is a cross sectional view taken along line 6—6 of FIG. 5.

FIGS. 5 and 6 show a regulation tennis ball of a conventional design but with the exterior surface formed with loops adapted to interact with the hooks on the net as shown in FIGS. 1, 2 and 4. Such tennis ball 40 is conventional in all respects as described above. On the surface of the tennis ball, however, the nap is formed to include loops 42 adapted to interact with the hooks 14 on the net meshwork portion 10 as shown in FIGS. 2 and 4. The coupling between the tennis ball and net occurs when the tennis ball is moved into contact with the net with the coupling being effected through the conventional technique as occurs through conventional hook and loop pile-type fasteners.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A regulation tennis ball and regulation tennis net arrangement comprising:

a string meshwork tennis net and a tennis ball having a nap covering, said string of said meshwork having the surface thereof covered with pile fastener elements which are adapted to mate and couple with said nap covering of said tennis ball to thereby attach said tennis ball to said tennis net upon impacts of said ball with net.

2. The regulation tennis ball and regulation tennis net as set forth in claim 1 wherein the net meshwork further comprises a suspension cord and a bottom hem weight for suspending the meshwork and keeping said meshwork taut during use, respectively.

* * * * *